US007874354B2

(12) United States Patent
Freyer

(10) Patent No.: US 7,874,354 B2
(45) Date of Patent: Jan. 25, 2011

(54) PACKER-ANCHORING DEVICE

(75) Inventor: Rune Freyer, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 166 days.

(21) Appl. No.: 11/913,100

(22) PCT Filed: May 8, 2006

(86) PCT No.: PCT/NO2006/000170

§ 371 (c)(1),
(2), (4) Date: Sep. 12, 2008

(87) PCT Pub. No.: WO2006/121340

PCT Pub. Date: Nov. 16, 2006

(65) Prior Publication Data

US 2009/0159265 A1 Jun. 25, 2009

(30) Foreign Application Priority Data

May 9, 2005 (NO) ..... 20052260

(51) Int. Cl.
*E21B 33/12* (2006.01)

(52) U.S. Cl. ..... 166/134; 166/179

(58) Field of Classification Search ..... 166/179, 166/134

See application file for complete search history.

(56) References Cited

U.S. PATENT DOCUMENTS

| | | | | |
|---|---|---|---|---|
| 2,726,722 | A | 12/1955 | Baker | |
| 2,797,759 | A | 7/1957 | Long et al. | |
| 2,885,009 | A | 5/1959 | Baker | |
| 2,945,541 | A * | 7/1960 | Maly et al. | 166/185 |
| 3,343,607 | A | 9/1967 | Current | |
| 3,358,766 | A | 12/1967 | Current | |
| 3,381,969 | A | 5/1968 | Crow et al. | |
| 3,385,679 | A | 5/1968 | Current | |
| 4,349,204 | A | 9/1982 | Malone | |
| 4,765,404 | A | 8/1988 | Bailey et al. | |
| 4,892,144 | A | 1/1990 | Coone | |
| 5,027,894 | A | 7/1991 | Coone et al. | |
| 6,318,482 | B1 | 11/2001 | Fidtje | |
| 6,581,682 | B1 | 6/2003 | Parent et al. | |
| 2004/0134659 | A1 | 7/2004 | Hoffman et al. | |

FOREIGN PATENT DOCUMENTS

WO WO2006121340 11/2006

OTHER PUBLICATIONS

Canadian Office Action issued Aug. 13, 2009, for Canadian Patent Application Serial. No. 2,606,771, 2 pages.
Chinese Office Action issued Jun. 13, 2010, for Chinese Patent Application Serial No. 200680016020.1, 5 pages.

* cited by examiner

*Primary Examiner*—Hoang Dang
(74) *Attorney, Agent, or Firm*—Marlin R. Smith

(57) ABSTRACT

A packer-anchoring device between an annular packer and a body, wherein the annular packer is provided, at least at one of its end portions, with an expandable end ring.

13 Claims, 3 Drawing Sheets

I–I

PACKER-ANCHORING DEVICE

CROSS-REFERENCE TO RELATED APPLICATIONS

The present application is a national stage filing under 35 USC 371 of international application no. PCT/NO06/000170, filed 8 May 2006, which claims priority to Norwegian application serial no. 20052260, filed 9 May 2005. The entire disclosures of these prior applications are incorporated herein by this reference.

This invention relates to a packer-anchoring. More particularly it concerns the anchoring of an expandable annular packer to a normally tubular object by means of a reinforcement and an expandable end ring, in particular for use in a borehole in connection with the recovery of petroleum It is known for expandable annular packers to be arranged round a production pipe or an injection pipe before the pipe is run into a borehole. The aim is typically to isolate part of the borehole from the rest of the borehole. The annular packer may be swellable and designed to swell in contact with a fluid present in the borehole, or it may be expanded by means of diffusion.

It has turned out that known methods of chemical bonding between an annular packer and a pipe, such as gluing or vulcanisation, do not exhibit sufficient strength when the packer is subjected to a relatively high temperature of use, for example during the recovery of petroleum.

The invention has as its object to remedy or reduce at least one of the drawbacks of the prior art.

The object is realized according to the invention through the features specified in the description below and in the following Claims.

An annular packer in accordance with the invention is provided, at least at one of its end portions, with an expandable end ring which encircles a body, to which the annular packer is connected. Between its inner mantle and its outer mantle the annular packer is preferably provided with a reinforcement encircling the body.

Typically, the expandable end ring is radially slit, alternately from its inside and from its outside. In a cross-sectional view, the end ring has an angular shape, one leg of the angle forming a disc-shaped part projecting inwards, and a second leg of the angle forming a sleeve part, the sleeve part extending in an encircling manner over the end portion of the annular packer.

The expandable end ring is preferably made of a synthetic material, for example PTFE. The reinforcement which is located in the packer material, is preferably of a helical shape and arranged to clamp the annular packer material to the body. The reinforcement may, with advantage, be metallic.

The use of an anchoring according to the invention essentially overcomes the drawbacks connected with the prior art anchoring of swellable packers. The invention reduces, to a considerable degree, the risk currently present of separation of the annular packer from the body.

In what follows there is described a non-limiting example of a preferred embodiment which is visualized in the accompanying drawings, in which.

Figure 1:
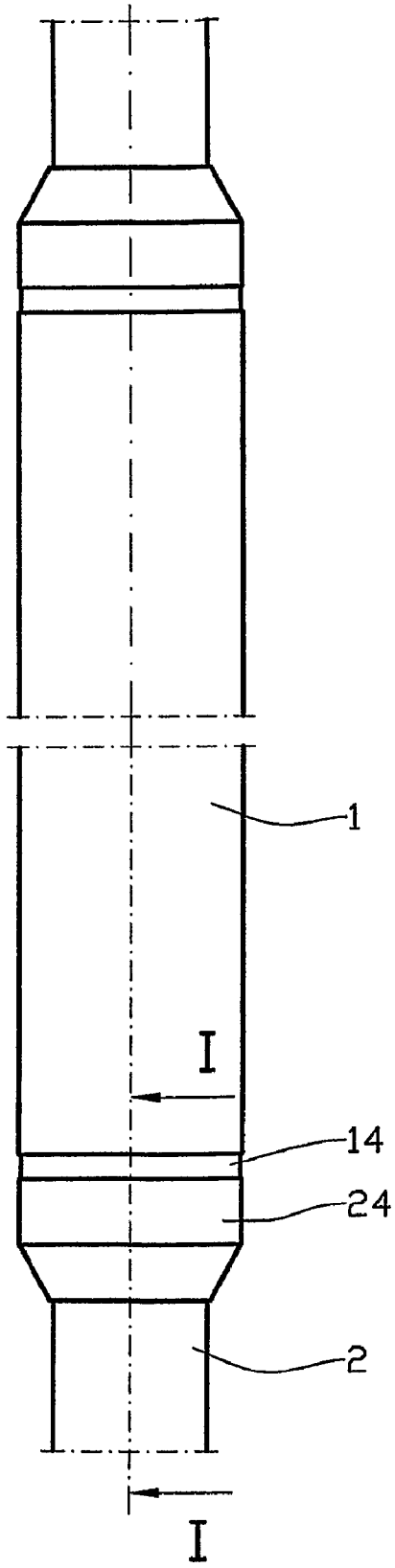
FIG. 1 shows a relatively elongate swellable annular plug encircling a pipe.
Figure 2:
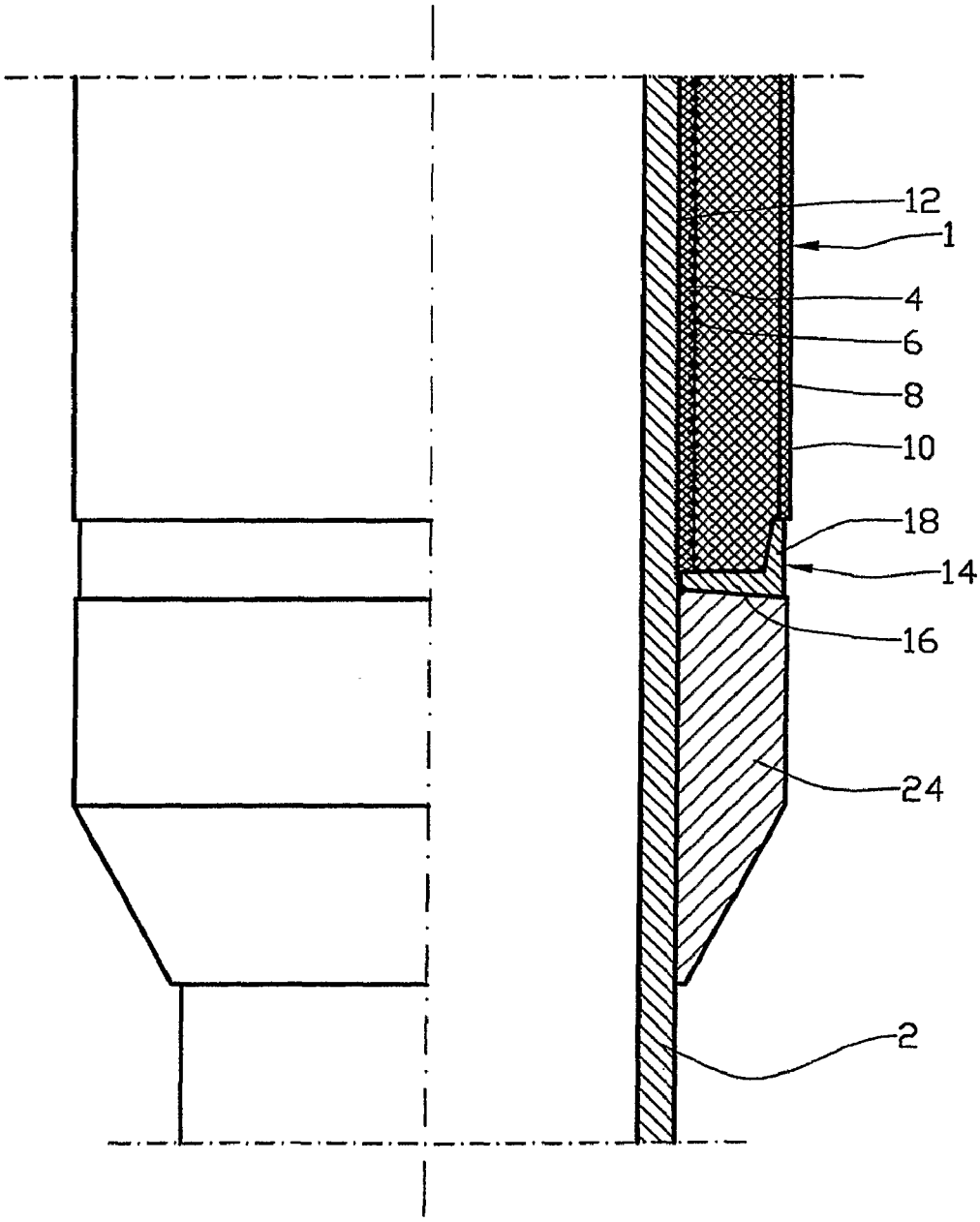
FIG. 2 shows, on a larger scale, a section of FIG. 1.

In the drawings the reference numeral 1 identifies a relatively elongate swellable annular packer encircling a body 2 in the form of a pipe.

The annular packer 1 is built up from a number of layers placed on top of each other, an inner layer 4 encircling the pipe 2 and being clamped against the pipe 2 by a helical reinforcement 6. The reinforcement 6 is typically formed by stainless wire.

Encircling the inner layer 4 and the reinforcement 6, there is arranged an intermediate layer 8, whereas an outer layer 10 encircles the intermediate layer 8. It is advantageous for the layers 4, 8 and 10 to be bonded together, for example by means of vulcanisation.

The layers 4, 8, 10 may be provided with fibres and have equal or different swelling. The pipe 2 may, with advantage, be provided with a thread-like groove 12 in the area of the annular packer 1.

At its end portions the annular packer 1 is provided with an expandable end ring 14 encircling the pipe 2 and having a cross-section in the shape of an angle. A first leg of the angle forms a disc 16 projecting radially inwards, whereas a second leg of the angle forms a sleeve 18 extending axially.

Figure 3:
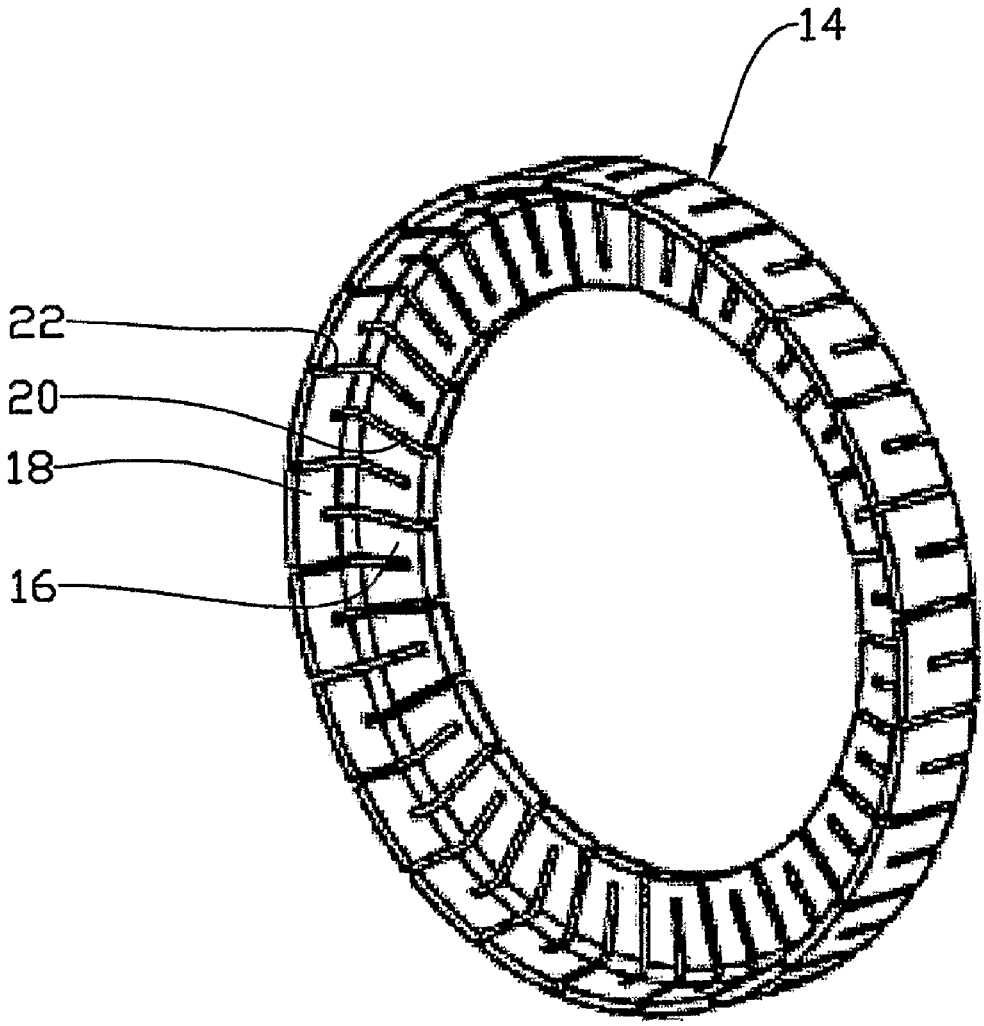
FIG. 3 shows in perspective an expandable end ring.

The end ring 14 is slit, see FIG. 3, by a number of first radial slits 20 extending from the inside, and a number of alternate second radial slits 22 extending from the outside. The end ring 14 is thereby sufficiently weakened to expand radially.

The disc 16 bears on the end portion of the annular packer 1, whereas the sleeve 18 encloses and extends somewhat over the same end portion.

The end ring 14 is supported by a supporting sleeve 24 which is connected to and encircles the pipe 2.

When the annular packer 1 has been run into a borehole, not shown, where it is swellingly influenced by a fluid, the volume of the annular packer 1 and thereby the external diameter are increased. During the expansion the reinforcement 6 is tensioned as there is an attempt to increase the diameter at which the reinforcement 6 is located. This helps the annular packer 1 to be further clamped to the pipe 2.

The diameter of the expandable end ring 14 increases with the external diameter of the annular packer 1, thereby preventing packer material from the annular packer 1 from entering an annular space, not shown, which encircles the supporting sleeve 24.

The invention claimed is:

1. A packer assembly, comprising:

an annular packer including at least one swellable seal material; and a radially expandable end ring positioned adjacent an end of the packer, the end ring including radially extending slits which permit radial expansion of an annular shaped portion of the end ring which abuts the packer in response to swelling of the seal material.

2. The packer assembly of claim 1, wherein the packer includes multiple layers of swellable seal material.

3. The packer assembly of claim 2, wherein the layers of swellable seal material swell differently.

4. The packer assembly of claim 2, further comprising a reinforcement positioned between the layers of swellable seal material.

5. The packer assembly of claim 1, further comprising a reinforcement embedded within the packer and helically wrapped about a generally tubular body.

6. A packer assembly, comprising:

a swellable annular packer; and an expandable end ring which expands radially as a volume of the packer increases, wherein the packer and the end ring each encircle a generally tubular body, and wherein the end ring is positioned between the packer and a supporting sleeve secured to the body.

7. The packer assembly of claim 6, wherein the packer comprises a material which swells in response to at least one of diffusion and contact with fluid.

8. The packer assembly of claim 6, wherein the end ring is slit radially between an interior and an exterior of the end ring.

9. The packer assembly of claim 6, wherein the end ring is slit longitudinally along a portion thereof which encircles the packer.

10. The packer assembly of claim 6, wherein a first portion of the end ring which encircles the packer expands radially as the volume of the packer increases.

11. The packer assembly of claim 10, wherein a second portion of the end ring which does not encircle the packer does not expand radially as the volume of the packer increases.

12. The packer assembly of claim 6, wherein a reinforcement in the packer encircles the body.

13. The packer assembly of claim 12, wherein the reinforcement extends helically about the body.

* * * * *